United States Patent [19]

Del Fabro

[11] 4,049,026

[45] Sept. 20, 1977

[54] BENDING APPARATUS HAVING A SHAPED MANDREL USED IN AUTOMATIC BENDING MACHINES FOR METAL WIRE AND BAR STOCK

[76] Inventor: Remigio Del Fabro, 62-33010 Reana Del Rojale, Villaggio Morena (Udine), Italy

[21] Appl. No.: 677,171

[22] Filed: Apr. 15, 1976

[30] Foreign Application Priority Data

Apr. 18, 1975 Italy ..... 83354/75

[51] Int. Cl.[2] ..... B21D 7/024

[52] U.S. Cl. ..... 140/105; 72/307; 72/388

[58] Field of Search ..... 140/80, 82, 102, 104, 140/105, 90, 92; 72/217, 218, 307, 321, 387, 388, 428, 463

[56] References Cited

U.S. PATENT DOCUMENTS

| | | | |
|---|---|---|---|
| 1,512,002 | 10/1924 | Kardong | 72/217 |
| 3,823,749 | 7/1974 | Ritter et al. | 140/105 |
| 3,857,271 | 12/1974 | Gott et al. | 140/105 |

*Primary Examiner*—Lowell A. Larson

*Attorney, Agent, or Firm*—Prutzman, Hayes, Kalb & Chilton

[57] ABSTRACT

An automatic bending apparatus for forming fasteners from metal wire strip, or bar stock includes a removable, axially movable, non-rotatable shaped central mandrel and a relatively rotatable faceplate mounting a bending pin disposed coaxially with the mandrel and independently axially movable relatively thereto. The apparatus includes a pair of shears positioned adjacent the mandrel along the path of movement of the stock and in advance of the mandrel and means for automatically feeding the stock. The invention is characterized in that the mandrel is substantially L-shaped and has a support rod and an arm with a U-shaped groove in the front face thereof through which the stock passes. The groove is dimensioned to closely receive the stock so that the supported portion therein is not deformed or bent during the bending operation and the external portion of the mandrel is shaped to define the curvature of the bent portions of the stock. The face of the mandrel is tapered to laterally deflect the previously bent end so that the other end may be bent without interference from a previously bent portion.

7 Claims, 22 Drawing Figures

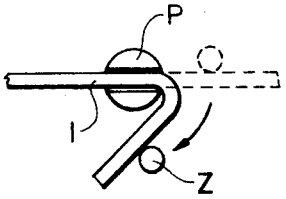
FIG. A
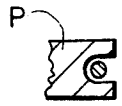
FIG. A'
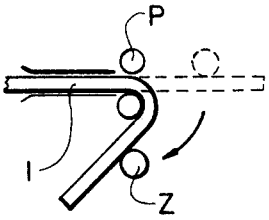
FIG.B
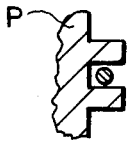
FIG. B'
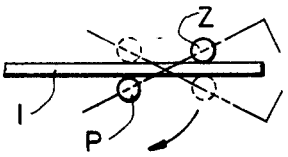
FIG. C
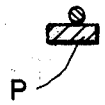
FIG. C'
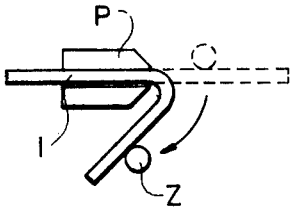
FIG.D
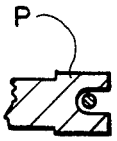
FIG. D'

BENDING APPARATUS HAVING A SHAPED MANDREL USED IN AUTOMATIC BENDING MACHINES FOR METAL WIRE AND BAR STOCK

The present invention relates to bending apparatus having a shaped mandrel used in machines for bending metal wire, bar and strip stock with continuous feeding and in particular for automatic bending machines used in the manufacture of wire formed fasteners and the like.

Automatic bending machines for forming wire, strip or bar stock for making fasteners and the like are known. Some such machines are provided with a bending apparatus comprising a central mandrel and at least one peripheral pin rotatable around the mandrel so as to bend the bar stock around the central mandrel or a part thereof. Some mandrels p, traditionally used in conjunction with the peripheral pin z for bending the bar stock 1 in a clockwise or counterclockwise direction, are provided with a central groove (see FIG. A) through which the bar stock 1 passes.

Other central mandrels are formed by two central pins which are disposed in close proximity to each other so that the bar stock to be bent passes therebetween. (See FIG. B). Other central mandrels are formed by a single pin p which can take alternate positions on either one side *p'* or on the other side p of the bar stock for the purpose of bending it in a clockwise or counterclockwise direction (see FIG. C). Other such mandrels are shaped from and comprised of a centrally grooved plate as shown in FIG. D. All these mandrels have a similar cross section as shown by way of example in the FIGS. A', B', C', and D'.

The disadvantages resulting from the use of such mandrels resides not only in the fact that once the bent bar stock 1 has been produced it is necessary to remove it from the machine by suitable means in order to remove it from the central pin, but more importantly the shape of the known central mandrels (see FIGS. A', B', C', D'), interfere with the bending of the bar stock for the purpose of making formed fasteners and if the fasteners are not bent out of the plane of bending, the bent portions will strike against the outside surface of the central mandrel. To avoid this, it is absolutely necessary to provide the central mandrel with a tapered wall to cause the fastener to shift out from its plane of bending so as to prevent it from striking against the mandrel. Moreover, since the central mandrels used up to now of the type as shown in the FIGS. A, B, or C do not provide a guide above the bar stock to be bent, they do not serve as an effective support for the bar stock and, because of the elasticity or flexibility of the bar stock, make it impossible to obtain a bend that has the desired bend radius.

While a mandrel of the type shown in FIG. D serves to provide effective support for the bar stock during bending, it does not permit bending the bar stock at an angle of 180° in the manner which is possible with the types in the FIGS. A, B, C. To make this possible, its wall thickness would be too thin to provide the necessary support. Moreover, a mandrel such as that of FIG. D must have a bar guiding section which is necessarily short due to the fact that immediately above it is located the bar cutting shears which must be disposed very closely to the mandrel, in order to avoid wasting material on account of too long, separate tails of each fastener which is formed from the bar stock.

The object of the invention is to eliminate all the aforementioned disadvantages essentially resulting from the shape of the central mandrel by making use of a new type of mandrel suitably shaped and sufficiently elongated for the guiding and supporting of the bar stock. This objective is obtained by providing a shape which combines the advantages of the mandrels of the FIGS. A and B with a shape which has the advantage of the mandrel of FIG. D to permit bending at an angle of 180° and have a suitable length of support for the bar stock adjacent the bend and thereby to form a single mandrel having a suitable shape and smooth body, thus avoiding the aforementioned disadvantages. Thus, according to the illustrated embodiment of the invention, the central guiding mandrel has essentially the shape of an "L" disposed on a horizontal axis with a longer arm or support rod thereof being located on the horizontal axis perpendicular to the axis of the feeding movement of the bar stock through the bending apparatus and with a shorter arm of the mandrel being in a position parallel to the axis of feeding movement of the bar stock, the shorter arm being provided with an essentially U-shaped groove to guide and support the bar stock to be bent on the section perpendicular thereto and thus to the axis of feeding movement of the bar stock and aligned with the bar stock which, so guided, passes through said U-shaped groove which is open to the front face of the shorter arm opposite the longer arm or rod.

The shorter guiding arm is, in addition to providing a horizontal axial groove, substantially elongated along the axis of feeding movement of the bar stock and it is shaped in such a manner that the aforesaid groove is flared at its free end as well as at its other end which is fixed to the longer arm or rod.

The external shape at the free end of the shorter arm of the mandrel is characterized by a considerable enlargement in height and by a reduction in width relative to its central portion which has substantially a semicircular cross section interrupted by said groove. At the end of the shorter arm of the mandrel which is fixed to the longer arm thereof, the shorter guiding and support arm is also of greater height than the central portion while having substantially the same width and has a semi-cylindrical cross sectional configuration on each side of the central U-shaped groove to form two semi-cylindrical bulbous parts symmetrical with the groove.

According to the invention, the aforesaid longer arm or support rod of the central mandrel is mounted in a hollow shaft so that it is axially slidable therein as controlled by a hydraulic cylinder.

The hollow shaft is keyed to a coaxial toothed gear to rotate the shaft and is also fitted on a disk which generates electrical impulses when rotating.

A face plate is coaxially fixed to one end of the hollow shaft and carries a pin which extends therefrom by about the same distance as the central mandrel. The face plate is rotatable relative to the mandrel through an arc of 360° minus the arc of a circle occupied by the free end of the shorter arm of the mandrel which guides and supports the bar stock. The pin functions as a means for bending the bar stock and together with the face plate and hollow shaft is movable axially independently of said central mandrel by means of another hydraulic cylinder. The pin is mounted on a movable slide formed in the face plate and can be radially adjusted on said face plate. The pin consists of an idler roller journaled on a shaft fixed to said slide to bend the bar stock which is supported and guided in the U-shaped groove in the central mandrel in a clockwise or counterclockwise direction around one of the two aforesaid semi-cylindrical bulbous parts of the mandrel.

The invention will be better understood from the accompanying drawings wherein:

FIGS. A to D and A' to D' are schematic views of conventional bending mandrels.

Figure 11:
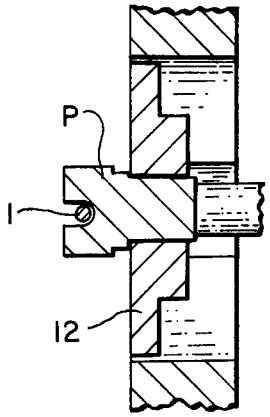
Figure 12:
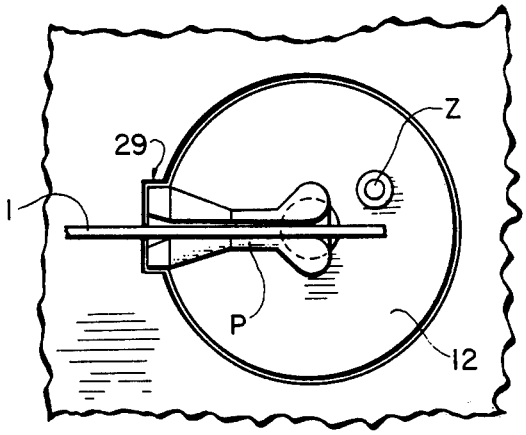
Figure 13:
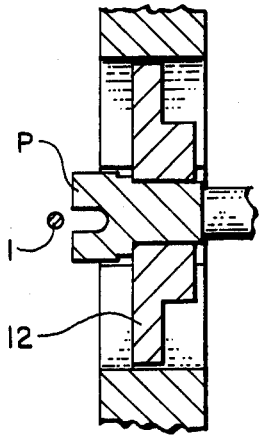
Figure 14:
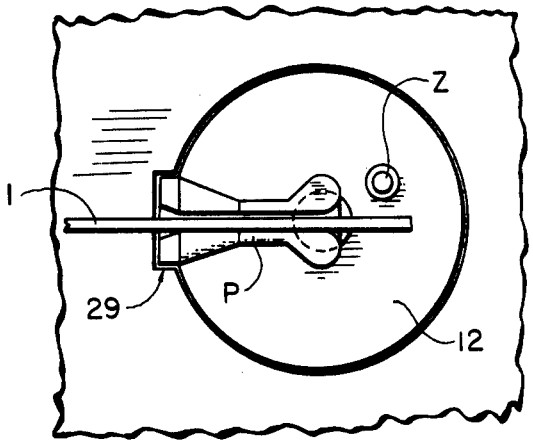

FIGS. 11 and 13 show an axial, diagrammatic view of the receding movements of the bending apparatus for removing the finished fastener; and FIGS. 12 and 14 show the partial front views of the bending apparatus of FIGS. 11 and 13.

Figure 8:
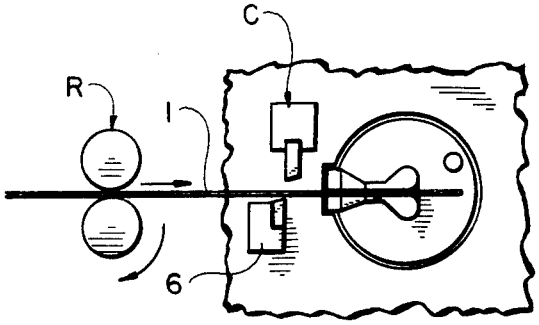
FIGS. 8, 9 and 10 show a partial, diagrammatic view of three phases of the bending and cutting operation of the apparatus.
Figure 9:
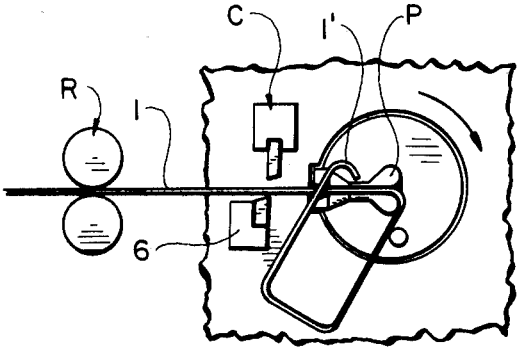

It is evident from the FIGS. 3, 4, 5, 6 and 7 that the central mandrel is essentially L-shaped and consists of a support arm or rod 3 and an arm 4 for supporting and guiding the bar stock, the arm 4 having a longitudinal groove 5 perpendicular to the axis of the support arm 3. The groove 5 is offset as shown at e with respect to the axis of the support rod 3 (FIG. 3) to keep the bar stock to be bent in line with the anvil 6 of the shears (see FIGS. 8, 9 and 10).

The groove 5 is flared at its entrance 7 to provide for the easy feeding of the bar stock. Furthermore, the thickness of the arm 4 is reduced towards its free end to such an extent that the depth of the groove 5 at its extremity is equal to zero or at any rate considerably reduced as shown at 7' of FIG. 7.

Figure 3:
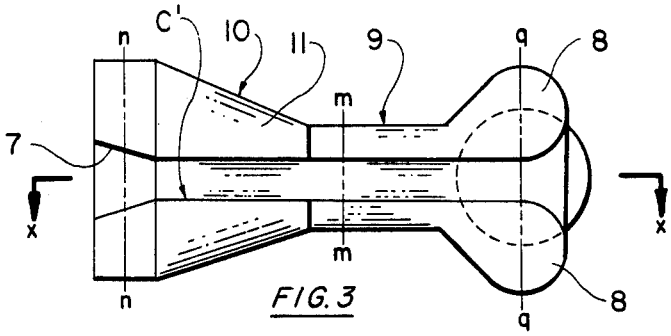
FIG. 3 is a front view of said central mandrel.
Figure 4:
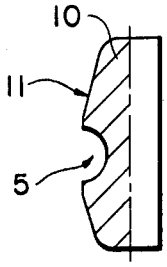
FIGS. 4 and 5 are the respective cross sections along the lines *n—n, m—m,* respectively of FIG. 3.
Figure 5:
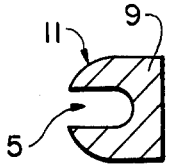
Figure 6:
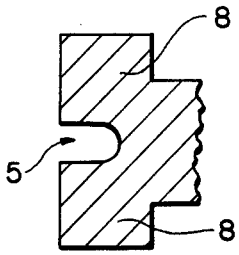
FIG. 6 is an axial section along the line *q—q* of FIG. 3.
Figure 7:
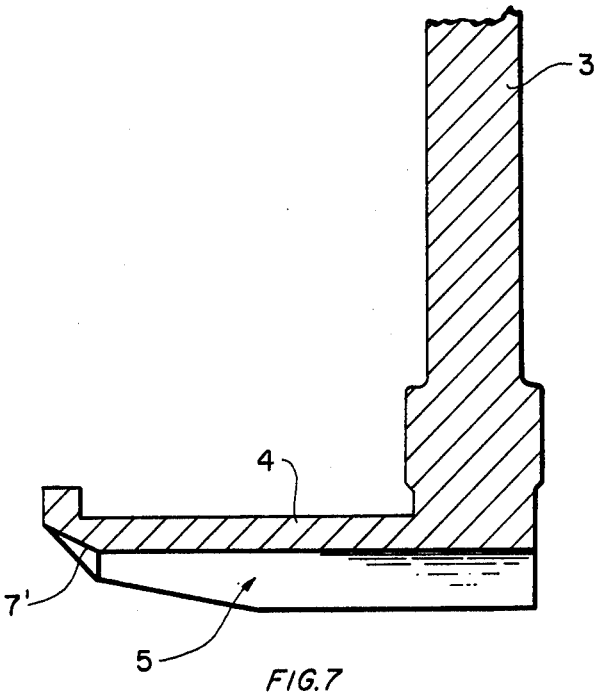
FIG. 7 is a fragmentary axial section along the line *x—x* of FIG. 3.

The end of arm 4 which is fixed to support rod 3 has an exterior surface formed by two bulbous parts 8 of large thickness opposite each other which have a curved shape with diverges from the groove 5 and take the form of two half-cylinders on opposite sides of the groove as shown in FIGS. 3, 6 and 7. The central portion of the arm 4 is of reduced height as shown at 9 in FIG. 5 but has the same thickness as the end portion 8 (FIGS. 3, 5, and 6). The arm 4 flares out to the increased height and as shown at 10 in FIGS. 3, 4 and 6 and has a reduced thickness. The central portion 9 and the end portion 10 have chamfered corners as shown at 11 of FIGS. 4 and 5.

The mandrel is mounted in the apparatus as indicated in the FIGS. 1 and 2 from which it is apparent that the mandrel p described with reference to the FIGS. 3, 4, 5, 6, and 7 is coaxially mounted relative to the face plate 12 which rotates about the support rod 3 on the bearings 21. The face plate 12 mounts the bending pin z consisting of a small idler roller on a shaft 14 which is attached to a slide member 15 which can be radially adjusted in radial grooved seat 16 of the face plate 12 and is secured to the face plate 12 by means of a screw 17.

The face plate 12 is attached by means of screws 19 and pins 20 to a hollow shaft 18 which is coaxial to the supporting rod 3 of the mandrel and rotates with the face plate 12 around the supporting rod 3 according to a preset program. By means of the bearings 23, the hollow shaft 18 is mounted on a frame 22 supporting the bending apparatus and the hollow shaft 18 is rotated by a toothed gear 24. The mandrel p is secured against rotation by a lug 29 received within a recess in the chassis s which is fixed to the frame 22. The frame 22, which supports the bending assembly and which can reciprocate on a slider as indicated by the arrows, is connected and controlled according to a preset program thus enabling it to reciprocate by means of the rod 25 attached to a hydraulic piston (not shown). Similarly, the rod 3 of the mandrel is connected to a hydraulic piston (not shown) which is independent of the first piston, while also operating according to a program, thus making it possible to control the reciprocation of the central mandrel p independently as well as simultaneously with the face plate 12 mounting the bending pin *z,* or alternatively only the face plate 12 with the respective bending pin *z* can reciprocate while keeping the mandrel *p* in a fixed position. On the coaxial hollow shaft 18 is mounted a pulley 28 which transmits the rotary motion to an impulse-counting disk (not shown) so as to determine the correct amount of rotation of the bending pin *z* in a preset cycle of operation.

The assembly operates as illustrated in the FIGS. 8, 9, 10, 11, and 13. From the feeding movement of the bar (FIG. 8) to the bending stages (FIG. 9) where it is clearly shown that the bar stock forming the fastener 1' is bent and yet allows an overlap or crossing with the bar stock 1 being fed on its inside without the possibility of interference due to the suitably tapered face of the free end of the central mandrel p as shown at 7' of FIG. 7. The reduced central portion 9 makes it possible to make a bend of more than 180° in the bar stock.

Figure 10:
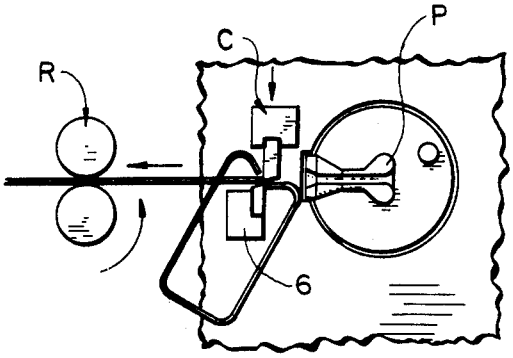

It is clear from FIG. 10 that in spite of the length of the mandrel p, the problem of the location of the shears C also is solved by causing the bar stock 1 to reverse by means of a reversed rotation of the feed rollers R for the purpose of cutting the bar stock of the fastener 1' at the length desired when the bending is completed.

Figure 1:
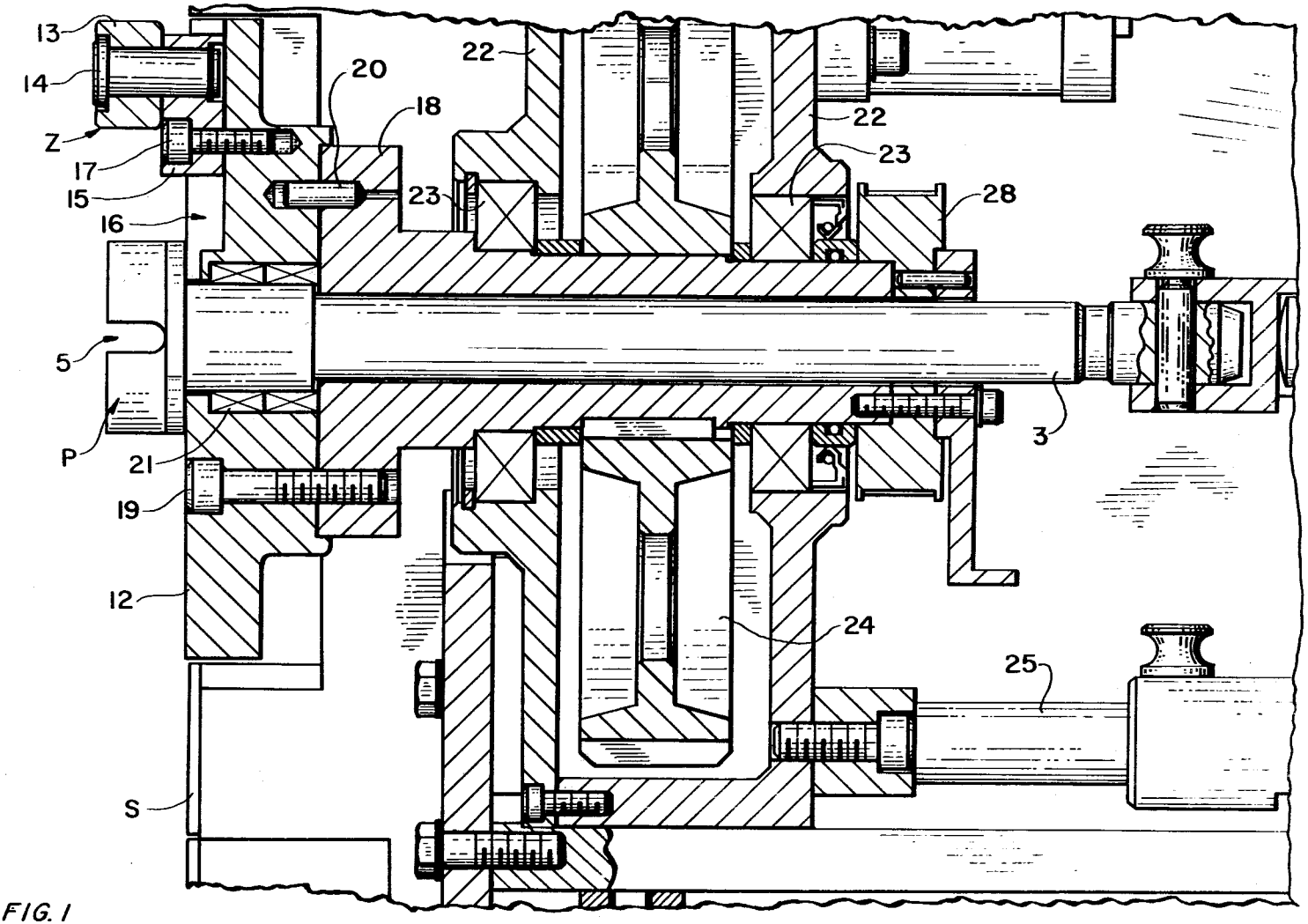
FIG. 1 shows by way of example a partial view of the axial section relative to the central mandrel of the bending apparatus.
Figure 2:
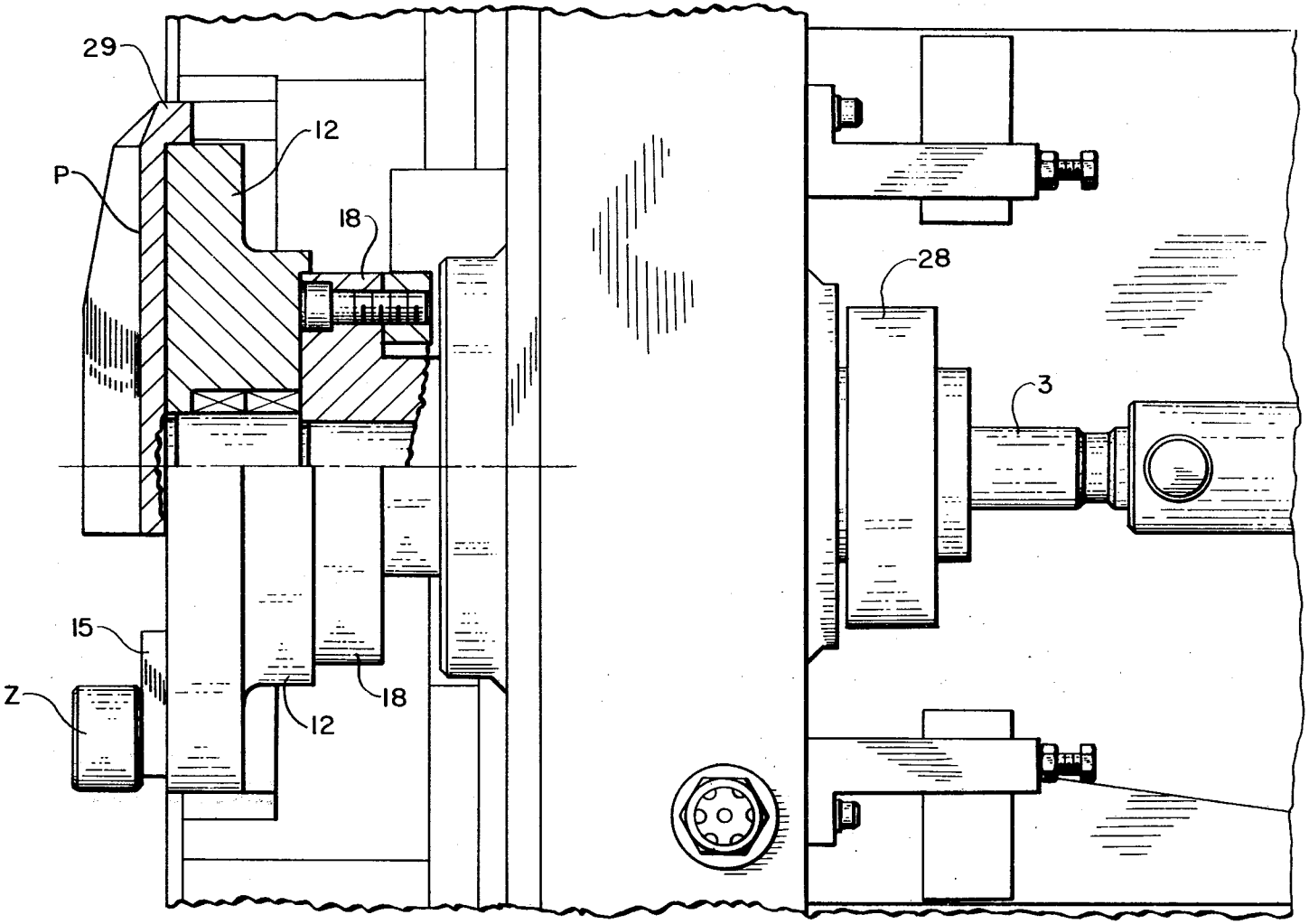
FIG. 2 is a partial view of a partial axial section perpendicular to the preceding one.

Of course, to enable reinsertion of the bar stock 1, the fastener 1', being in its way, it is necessary for the bending apparatus including central mandrel *p,* the face plate 12 and bending pin *z* to shift from the position of the FIGS. 1, 2 and 11 to the position of FIG. 13.

The invention is, of course, not limited to the exemplified embodiments shown and described above, from which other forms and embodiments can be derived, the specific details being variable while remaining within the scope and spirit of the invention as explained and described in the claims hereunder.

I claim:

1. Bending apparatus for use in automatic bending machines for metal wire, strip or bar stock and in particular for automatic bending machines for forming fasteners with continuous feeding comprising an axially movable, removably mounted, non-rotatable shaped central mandrel and a relatively rotatable and axially movable faceplate mounting a peripheral bending pin disposed coaxially therewith, a pair of shears disposed adjacent the mandrel in advance of the mandrel along the path of the movement of the stock past the mandrel, and means to automatically feed the stock through the mandrel, characterized in that the said central non-rotatable mandrel has substantially an L-shape and comprises a support rod lying axially at the center of rotation of said bending pin and an arm disposed perpendicularly to the support rod and having a U-shaped groove in the front face thereof, the groove being dimensioned to provide a passage for and to closely receive the stock to support the received portion against bending during bending and means for actuating the shears to sever the fastener from the stock after it is formed.

2. Bending apparatus according to claim 1 characterized in that it has, at the exit end of the groove, an enlargement in the form of two semi-cylindrical bulbous parts symmetrically disposed on opposite sides of said groove to define the curvature of the bent portion.

3. Bending apparatus according to claim 2 characterized in that the upstream end of said U-shaped groove of said L-shaped non-rotatable mandrel has a greater height than the midsection and the front face thereof so that the groove is tapered to reduce the depth of the groove.

4. Bending apparatus according to claim 1 characterized in that the said faceplate mounts a slide on which there is disposed an idler roller to effect the bending of the stock which projects out of the groove of the mandrel, the faceplate being fixed on a hollow shaft which is rotatable around and is axially movable relative to said mandrel, said hollow shaft being coaxial with the support rod for said mandrel, said hollow shaft being axially movable along the axis of rotation thereof independently of said mandrel.

5. Bending apparatus according to claim 1 characterized in that the axis of said groove substantially intersects the axis of said support rod for said mandrel.

6. Bending apparatus according to any of the claim 1 characterized in that said pair of shears has an anvil and a cutting blade which cooperates therewith and the centerline of said groove is laterally offset from the axis of said support rod of said mandrel by a distance proportional to the sectional dimension of the bar stock to be bent in order that the lower face of said groove is in alignment with the upper edge of the anvil of the shears disposed adjacent the mandrel.

7. Bending apparatus according to claim 6 wherein said mandrel is moved axially to release the formed fastener from the U-shaped groove as the shears sever the fastener from the stock.

* * * * *